United States Patent [19]

Tallon

[11] 4,058,917

[45] Nov. 22, 1977

[54] WHEEL DISK DISPLAY AND PLACARD HOLDER

[75] Inventor: James I. Tallon, Cuyahoga Falls, Ohio

[73] Assignee: McNeil Corporation, Akron, Ohio

[21] Appl. No.: 628,548

[22] Filed: Nov. 3, 1975

[51] Int. Cl.[2] ..... G09F 7/00

[52] U.S. Cl. ..... 40/125 M

[58] Field of Search ..... 40/125 M, 129 R, 129 B, 40/11 R, 1 T, 20 R, 23 R, 306, 307, 331; 301/37 R, 37 P, 37 CM, 37 SS, 37 C, 37 CD, 37 TP, 37 PB, 108 R, 108 A

[56] References Cited

U.S. PATENT DOCUMENTS

| | | | |
|---|---|---|---|
| 84,804 | 12/1868 | Dickerman | 40/17 |
| 1,943,237 | 1/1934 | Harrington | 40/125 M |
| 2,737,743 | 3/1956 | Knapp | 40/125 M |
| 3,112,958 | 12/1963 | Lyon | 301/37 PB |
| 3,426,463 | 2/1969 | Weisenbach | 40/125 M |
| 3,864,860 | 2/1975 | Merzweiler | 40/125 M |

*Primary Examiner*—Robert B. Reeves
*Assistant Examiner*—H. Grant Skaggs
*Attorney, Agent, or Firm*—Hamilton, Renner & Kenner

[57] ABSTRACT

A wheel disk display and placard holder adapted to be mounted within the bead portion of a pneumatic tire having a decorative surface extending generally radially and to an extent axially outwardly of a central projecting hub, a circumferential flange positioned outwardly of the decorative surface to selectively receive a generally flat placard, and retainers on the circumferential flange to maintain a placard in place within the wheel disk after its insertion into the confines of the circumferential flange.

9 Claims, 4 Drawing Figures

WHEEL DISK DISPLAY AND PLACARD HOLDER

BACKGROUND OF THE INVENTION

The present invention relates to a wheel disk for mounting on a pneumatic tire for display purposes to present either the more pleasing appearance of a tire mounted on a simulated wheel or a message printed on a placard detachably retained by the wheel disc. More specifically, a wheel disk according to the invention has a configuration and decorative surface to give the appearance of a mag wheel and has lugs placed in a circumferential rim to retain a placard biased thereagainst by a raised central hub of the wheel disk, thereby providing a multifunctional, versatile advertising display device.

The tire sales industry has recognized for many years that the addition of decorative embellishments to a tire is advantageous in respect to promotion and sales functions. This is logically explained by the rather bland appearance of a largely black colored generally torodial object. It has been further recognized that filling the central opening of the generally toroidal configuration enhances the overall appearance of a tire in a decorative manner without significant sacrifice with respect to the viewing of the most significant portions such as the tread and sidewall areas.

Efforts to effect improvements in tires for promotional and sales purposes have fallen generally into two different categories. On the one hand, efforts have been made to simulate the appearance of a tire being mounted on a wheel configuration suggestive of the appearance of a tire in a vehicle environment. Closely akin thereto are examples of the attachment to a tire of a simulation of a hub cap or wheel cover. On the other hand, apparatus has been provided which makes it possible to mount a placard, poster or other cardboard or plastic member conveying an advertising message. These latter devices have undergone sophistication or combinations thereof. However, these prior art devices have generally exhibited on or more disadvantages such as being overly complex, being difficult and time consuming to erect, and lacking in versatility with respect to altering the decorative format.

SUMMARY OF THE INVENTION

Accordingly, it is an object of the present invention to provide a wheel disk and display placard holder which is capable of both holding a placard containing a message sought to be presented to prospective purchasers and presenting a pleasing appearance when no placard is used.

It is another object of the present invention to provide a wheel disk in which advertising placards are securely retained and can be easily and quickly inserted or removed as desired.

It is a further object of the present invention to provide a wheel disk in which the advertising placards can be changed as desired while retaining the same wheel disk with a decorative face, e.g., in the form of a simulated wheel, to present a pleasing appearance when no placard is being used.

It is yet another object of the present invention to provide a wheel disk of a configuration such that it may be readily fabricated of a relatively light gauge sheet material such as any of a number of plastics.

It is a still further object of the present invention to provide a wheel disk having the specified capabilities which may be formed as an integral piece for ease of manufacture and to eliminate the necessity for a plurality of individual parts which might be displaced or lost.

Yet a further object of the invention is to provide a wheel disk having the specified versatility while being relatively inexpensive to manufacture.

These and other objects of the present invention, together with the advantages thereof over the existing and prior art forms which will become apparent from the description to follow, are accomplished by the wheel disk hereinafter shown, described and claimed.

In general a wheel disk in accordance with the present invention is constituted as a display item and is adapted to selectively receive a substantially flat placard. The wheel disk has a decorative surface extending generally radially and to an extent axially outwardly of a central hub, a circumferential flange positioned outwardly of the decorative surface to selectively receive a placard, and retainers on the circumferential flange to maintain a placard in place relative to the wheel disk after its insertion into the confines of the circumferential flange. The central hub may project a sufficient distance axially outwardly to bias a placard against the retainers, and a lateral offset may be interposed between the decorative surface and the circumferential flange to limit axial displacement of a placard inwardly of the wheel disk.

DESCRIPTION OF THE PREFERRED EMBODIMENT

Figure 1:
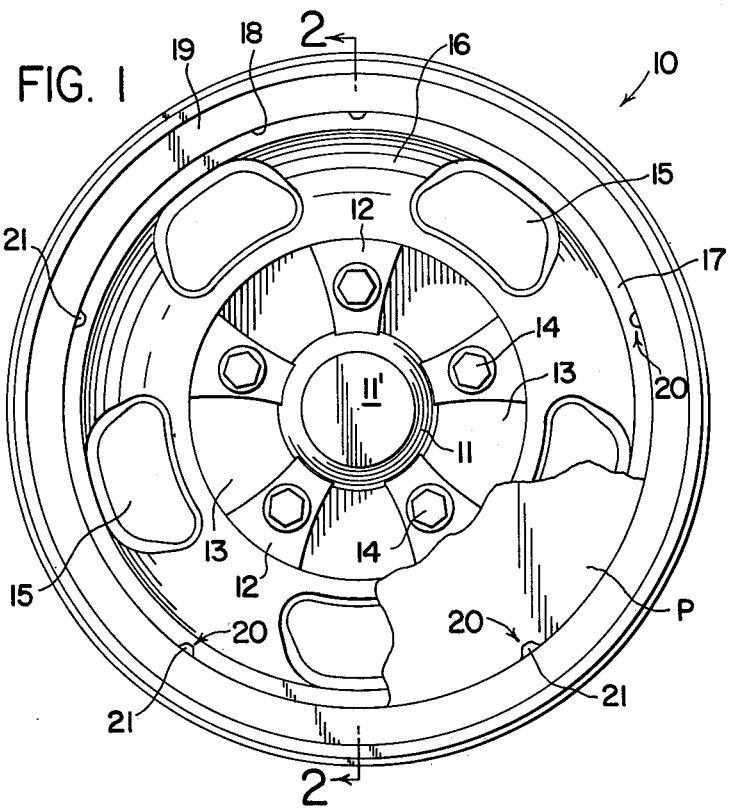
FIG. 1 is a front elevational view of a wheel disk embodying the concepts of the present invention with a cut-away portion of a placard inserted in the lower right corner thereof to generally depict its positioning therein.

Referring now to the drawings, an exemplary wheel disk according to the present invention is indicated generally by the numeral 10. The wheel disk 10 is preferably made of a relatively rigid sheet material, as for example, a suitably compounded plastic material capable of vacuum molding in a single piece so as to maximize manufacturing simplicity while retaining good durability features. Besides the variety of plastic materials which would be appropriate, as would be readily apparent to one skilled in the art, the wheel disk could also be made of or coated with any one of a number of metallic or other materials. The outside face of wheel disk 10 as seen in FIG. 1 can have a sculptured decorative surface to simulate the appearance of a mag wheel, thereby providing an attractive appearance while giving structural integrity to the wheel disk 10. While a variety of decorative surfaces could be employed, the surface shown extends from a central hub 11, having a face portion 11', and has five equidistant radially extending ribs 12 emanating therefrom. The ribs 12 may be spaced and joined by alternating depressed recesses 13. Five lug nuts 14 are superimposed upon the ribs 12 to simulate wheel attachment devices. Five circumferentially equidistantly spaced ports 15 are disposed radially outwardly of the extending ribs 12 and may be formed in a curved surface 16 extending radially outwardly and axially in the direction of the face portion 11' of hub 11. The above-described structural features generally establish an environment which is common to wheel configurations as a whole, whether actual or simulated.

A number of components of wheel disk 10 contribute to the retention of the device in a cured tire (not shown) or are a factor in the placement and/or retention of a generally flat placard P which is adapted for carrying a printed message or other advertising depiction. The placards P may be made of cardboard, plastic, or comparable materials which are sufficiently inexpensive such that a placard may be used for a limited special purpose such as seasonal advertising or sale literature and thereafter discarded. The above-described structural features of wheel disk 10 provide the additional flexibility of a wheel simulation which is extant when no placard is being employed in conjunction with a display.

Figure 2:
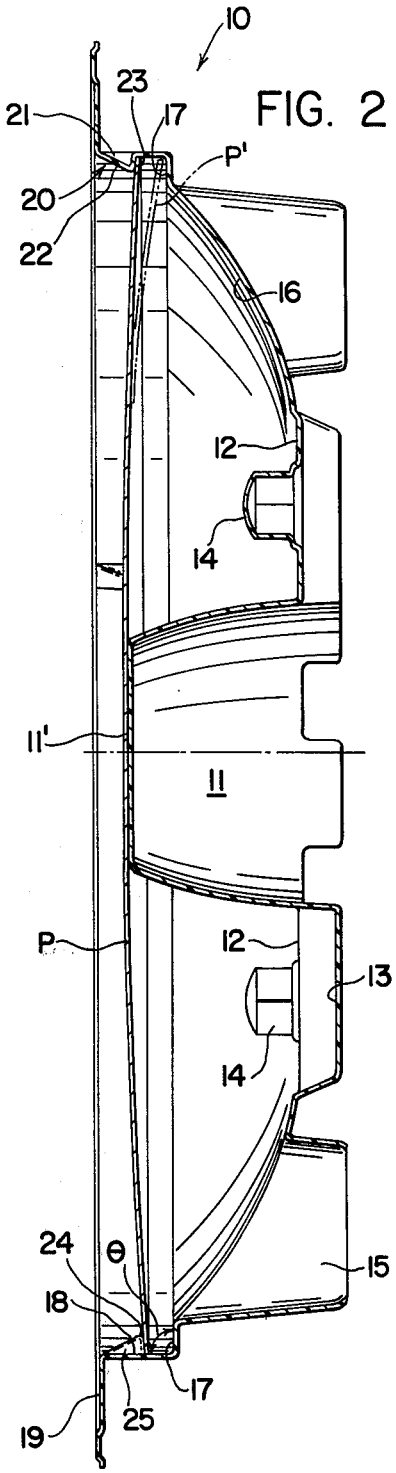
FIG. 2 is an enlarged side sectional view of the wheel disk of FIG. 1 taken substantially along line 2—2 of FIG. 1 and showing particularly the relation between an exemplary placard installed therein and the structural elements of the disk.

The curved surface 16 merges at its outer extremity into a lateral offset 17 which, as best seen at the top of FIG. 2, constitutes the farthest axial extent that an appropriately sized placard P can be inserted into wheel disk 10.

The lateral offset 17 merges at its radially outward extremity into a circumferential engagement flange 18. Flange 18 is preferably oriented outwardly at an angle $\theta$ with respect to offset 17 of slightly greater than 90° (as seen in FIG. 2 of the drawings) to facilitate the insertion of the wheel disk 10 into a tire while providing a progressively tight frictional engagement between the circumferential flange 18 and a bead of a tire and to accommodate minor variations in tire bead size and configuration. The circumferential engagement flange 18 merges into a lateral stop rim 19 which is preferably generally at right angles thereto. The lateral stop rim 19 serves to limit the axial travel of wheel disk 10 into a tire and cover the bead portion of the tire to further enhance the appearance of the display.

Figure 3:
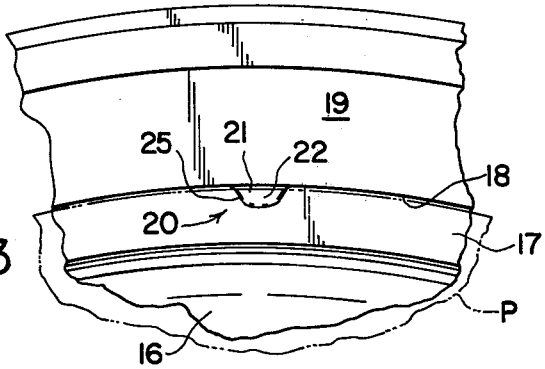
FIG. 3 is an enlarged fragmentary front elevational view of the wheel disk of FIG. 1 showing particularly one lug member thereof in relation to an exemplary placard; and, FIG. 4 is an enlarged fragmentary elevational view, as seen from directly radially inwardly of one of the lugs depicted in FIGS. 1–3.
Figure 4:
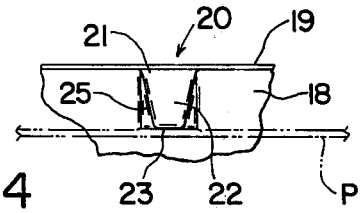

The selective insertion and removal of placards P from the wheel disk 10 is effected by means of a plurality of retainers, generally indicated by the numeral 20, which are preferably located proximate the axially outer extremity of disk 10 where its dimensions approximate those of a tire bead. As shown, the circumferential engagement flange 18 has lugs 21 molded into its surface to retain placard P when it is inserted into wheel disk 10. The lugs 21 are preferably equally spaced about the circumferential engagement flange 18, and, by way of example, FIG. 1 of the drawings shows the use of five lugs 21. As best seen in FIGS. 2 and 4, the lugs 21 have a tapered surface 22 which facilitates the insertion of a placard P into the wheel disk 10. The tapered surface 22 preferably starts flush to the surface of the circumferential engagement flange 18 at the point it merges into the lateral stop rim 19 and rises radially and axially inwardly until it merges into a generally radially outwardly extending stop leg 23, as best seen in FIGS. 2 and 3 of the drawings. This provides a type of snap fit wherein the placard P is snapped into the wheel disk 10 by a slight flexing of the placard P or wheel disk 10, or both, and retained between the stop leg 23 of the lug 21 and the lateral offset 17.

In order to maintain the placard P in a stabilized position and to preclude its becoming canted in the area between lug 21 and lateral offset 17, the hub 11 may be configured to project axially outwardly such that its face portion 11' lies approximately in, or preferably extends slightly beyond, the plane in which stop legs 23 of lugs 21 lie. In this manner, the placard P once in place, is maintained biased against the stop legs 23 of the lugs 21 by the face 11' of hub 11, as best seen in FIGS. 2 and 4 of the drawings. Thus, althoughportions of a placard P may be flexed axially inwardly against offset 17 as shown in the P' position of FIG. 2 to facilitate insertion and removal, a placard, once properly inserted, normally assumes the solid line position of FIG. 2.

As best seen in FIGS. 3 and 4, the juncture between the tapered surface 22 and the stop leg 23 of lug 21 is preferably a smoothly beveled surface 24 as best seen in FIG. 2 for purposes of permitting sliding passage of the placard P during its insertion and removal while minimizing the possibility of abrasion or other damage to the face or edge of a placard P. In addition, for purposes of maintaining optimum appearance and functioning of the lugs 21, the tapered surface 22 may be joined to the engagement flange 18 by a smoothly sloping or covered surface 25 as best seen in FIGS. 3 and 4.

Thus it should be apparent from the foregoing description of the preferred embodiment that the invention herein shown and described accomplishes the above-enumerated and other objects of the invention.

What is claimed is:

1. A wheel disk for mounting on the bead portion of a tire for display purposes in which a substantially flat placard may be selectively positioned comprising, a surface in the wheel disk extending generally radially and axially outwardly, a circumferential flange positioned radially outwardly of said surface for engaging the bead of the tire to hold the wheel disk in place therein, retaining means on said circumferential flange to maintain the placard in place after its insertion into the confines of said circumferential flange, said retaining means including a plurality of circumferentially spaced lugs having a substantially radial stop leg thereon to limit the axially outward travel of the placard when positioned in the wheel disk and having a tapered surface starting substantially flush to the surface of said circumferential engagement flange and rising axially and radially inwardly to said stop leg to facilitate the insertion of the placard in the wheel disk, and a central hub extending axially outwardly of said surface to bias the placard against said retaining means for stabilizing the placard in the wheel disk.

2. A wheel disk according to claim 1 further comprising, a lateral offset interposed between said surface and said circumferential flange to limit the axially inward travel of the placard positioned in the wheel disk and spaced axially from said retaining means a distance substantially greater than the thickness of the placard.

3. A wheel disk according to claim 2 wherein the angular relation between said circumferential flange and said lateral offset is slightly greater than 90°.

4. A wheel disk according to claim 1 further comprising, a lateral stop rim extending radially outward from said circumferential engagement rim to limit the axially inward travel of the wheel disk into the tire.

5. A wheel disk according to claim 4 wherein the angular relation between said circumferential engagement flange and said lateral stop rim is approximately 90°.

6. A wheel disk according to claim 1, wherein the juncture between said stop legs and said tapered surfaces of said lugs are rounded to facilitate insertion and removal of the placard relative to the wheel disk.

7. A wheel disk for mounting on a pneumatic tire for display purposes and adapted to selectively retain a generally flat placard comprising, disk like surface means curving generally radially and axially outwardly, circumferential flange means positioned radially outwardly of said surface, retaining means on said circumferential flange means to restrain the placard from axially outward travel after its insertion into the confines of said circumferential flange means, said retaining means being circumferentially spaced lugs each having a substantially radial stop leg to limit the axially outward travel of a placard when positioned in said circumferential flange means in the wheel disk and having an axially and radially inwardly tapered surface extending from said circumferential flange means to said stop leg to facilitate the insertion of the placard in the wheel disk, and lateral offset means interposed between said circumferential flange means and said surface means and spaced from said retaining means to limit the axially inward travel of the placard when positioned in the wheel disk.

8. A wheel disk according to claim 7 further comprising, hub means extending from said surface means to axially bias the placard against said radial stop leg of said retaining means for stabilizing the placard in the wheel disk.

9. A wheel disk according to claim 7 wherein said hub means has a face portion for engaging the placard positioned axially outwardly of said stop leg and said lugs have coved surfaces joining said tapered surface and said circumferential flange means.

* * * * *

UNITED STATES PATENT OFFICE
CERTIFICATE OF CORRECTION

PATENT NO. : 4,058,917

DATED : November 22, 1977

INVENTOR(S) : James I. Tallon

It is certified that error appears in the above-identified patent and that said Letters Patent are hereby corrected as shown below:

Col. 1, line 39 after "sophistication" insert --in the form of incorporating moving or lighted members--

Col. 1, line 41, after exhibited "on" should read "one"

Col. 2, line 3 "displaced" should read "misplaced"

Col. 4, line 12, "althoughportions" should read "although portions"

Col. 4, line 28 "covered" should read "coved"

Signed and Sealed this

*Fourth* Day of *April 1978*

[SEAL]

*Attest:*

RUTH C. MASON
*Attesting Officer*

LUTRELLE F. PARKER
*Acting Commissioner of Patents and Trademarks*